United States Patent [19]

Budd

[11] Patent Number: 4,520,605

[45] Date of Patent: Jun. 4, 1985

[54] DECORATIVE MOLDING FOR TUB OR COUNTER CAULKING

[76] Inventor: Richard W. Budd, 9785 Huntcliff Trace, Atlanta, Ga. 30338

[21] Appl. No.: 423,564

[22] Filed: Sep. 27, 1982

[51] Int. Cl.[3] ..... E04F 19/04

[52] U.S. Cl. ..... 52/287; 52/35; 52/288; 52/716; 428/131; 428/134; 428/122

[58] Field of Search ..... 428/122, 131, 134, 138; 52/35, 273, 287, 288, 716

[56] References Cited

U.S. PATENT DOCUMENTS

| | | | |
|---|---|---|---|
| 2,090,588 | 8/1937 | Witsell | 52/35 |
| 2,303,864 | 12/1942 | Reasor | 52/717 |
| 2,533,591 | 12/1950 | La Barre | 4/173 |
| 2,541,768 | 2/1951 | Keller | 52/287 |
| 3,331,172 | 7/1967 | Blanchet | 52/288 |
| 4,091,586 | 5/1978 | Schwartz | 52/287 |

FOREIGN PATENT DOCUMENTS

| | | | |
|---|---|---|---|
| 659588 | 10/1951 | United Kingdom | 52/288 |

*Primary Examiner*—Alexander S. Thomas
*Attorney, Agent, or Firm*—Jones & Askew

[57] ABSTRACT

A water tight decorative molding comprising two elongate side strips joined by an outward facing intermediate elongate strip for sealing and protecting a joint formed by the intersection of two surfaces. A plurality of perforations extend from the outward facing intermediate strip into a cavity between the two elongate side strips, increasing the surface area to which caulking may bond. After a bead of caulking is applied to the intersection of the two surfaces, the molding is laid over the caulking and is then firmly pressed down along its entire length. By firmly pressing the molding to snugly fit between the surfaces, the caulking material fills the cavity between elongate side strips and the perforations, providing a water tight seal.

4 Claims, 4 Drawing Figures

DECORATIVE MOLDING FOR TUB OR COUNTER CAULKING

BACKGROUND OF THE INVENTION

The present invention relates generally to molding strips and relates in particular to a waterproofing molding for installation at the juncture of two surfaces. The molding exhibits improved adhesive properties resulting from a perforated decorative design.

Areas of water infiltration are often found around bathtubs, shower walls and floors, bathroom vanity areas, kitchen counters and back splash areas or where any two surfaces join in a frequently wet environment. Commonly this juncture is filled with a caulking compound to prevent water collection and damage. The caulking either is used alone or is sometimes covered with a corner molding to provide additional protection. Although such molding serves primarily as a sealant against water penetration, molding is sometimes used solely for its aesthetic value in the decoration of the juncture of surfaces.

One of the problems encountered in using only a bead of the caulking to seal the juncture between a wall and another surface is the lack of sufficient surface area between the caulking and a molding for reliable sealing. Movement or settling of the two surfaces can cause the caulking or molding seal to separate from the surfaces to which it is attached, allowing moisture to enter the juncture and cause deterioration. A further problem is that the bead of caulking is often not applied to the joint in a even manner and can have a lumpy, unpleasant appearance.

Sealing a joint with conventional molding has many of the same problems as sealing the joint with caulking. With age, the walls in a dwelling naturally settle and the seal formed between a rigid, conventional molding and caulking is often broken with the movement of the walls, allowing water to seep into the joint.

SUMMARY OF THE INVENTION

The present invention overcomes the aforementioned problems by providing a larger surface area in the molding to which the caulking may adhere. The increase in surface area is accomplished in several ways. First, when the molding embodying the present invention is pressed down on a bead of caulking over a joint to be sealed, a longitudinal cavity in the center of the molding fills with the caulking thereby providing a larger surface area in the molding to which the caulking may adhere.

A second waterproof seal is provided by the sides of the molding which curve away from the wall and under which more caulking may be applied. A bead of caulking may also easily be applied to the top and bottom edges of the molding. Any excess caulking is then wiped away, leaving a pleasing thin caulking line. Furthermore, the molding is flexible so that the curved sides will tend to form suction on the surface which will further hold the molding against the wall.

Finally, numerous perforations imparted to the molding which extend from the outer surface of the molding to the cavity to form a decorative pattern allow the caulking to fill the cavity and the perforations when the molding is pressed onto the bead of caulking. The surface area for adhesion is thereby advantageously increased by the perforated decorative design, and also allows reveal of the caulking. Complementary or contrasting colors of caulking may be employed to accentuate the aesthetic appearance of the caulking reveal. The result is a stronger, more waterproof and longer lasting seal, as well as a pleasing decorative pattern. Thus, an object of this invention is to provide a waterproofing seal to prevent water and moisture from infiltrating susceptible areas.

A further object of this invention is to provide an improved decorative molding for sealing the juncture between the two surfaces.

A further object of this invention is to provide an increased surface area of a molding to which caulking may adhere, thus increasing the strength of the bond between the molding and the surfaces to be waterproofed.

A further object of this invention is to provide a pleasing aesthetic design on the molding formed by perforations which allow caulking reveal.

A further object of this invention is to provide a unique method of installing the molding which assures a leakproof joint with the intersecting surfaces.

Other objects, features and advantages of the present invention will become apparent upon reading the following specification when taken in conjunction with the accompanying drawing.

BRIEF DESCRIPTION OF THE DRAWINGS

In order that the invention may be clearly understood and readily carried into effect, an embodiment will now be described, by way of example only, with reference to the accompanying drawing wherein.

DETAILED DESCRIPTION

Figure 1:
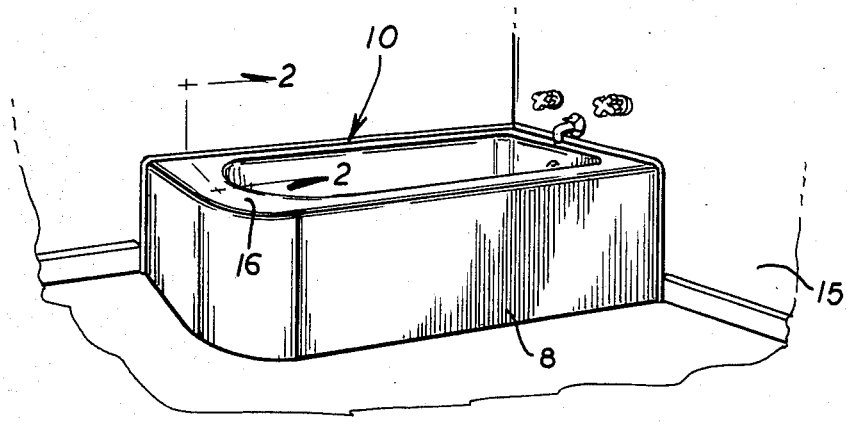
FIG. 1 is a perspective view of the a bathtub with the molding embodying the present invention installed at the intersection of the tub surfaces with the bathroom walls.

Referring now to the drawings, in which like numbers indicate like elements throughout the several views, FIG. 1 shows a typical bathtub 8 intersecting a wall 15. When the tube 8 is initially installed, the wall 15 is finished off so as to meet the tub upper surface 16. If the intersections between the surface 16 of the tub 8 and the wall 15 are not sealed and waterproofed, water may seep into the intersection and cause deterioration. To seal the intersection and provide a pleasing decorative effect, the molding 10 embodying the present invention is used.

Figure 2:
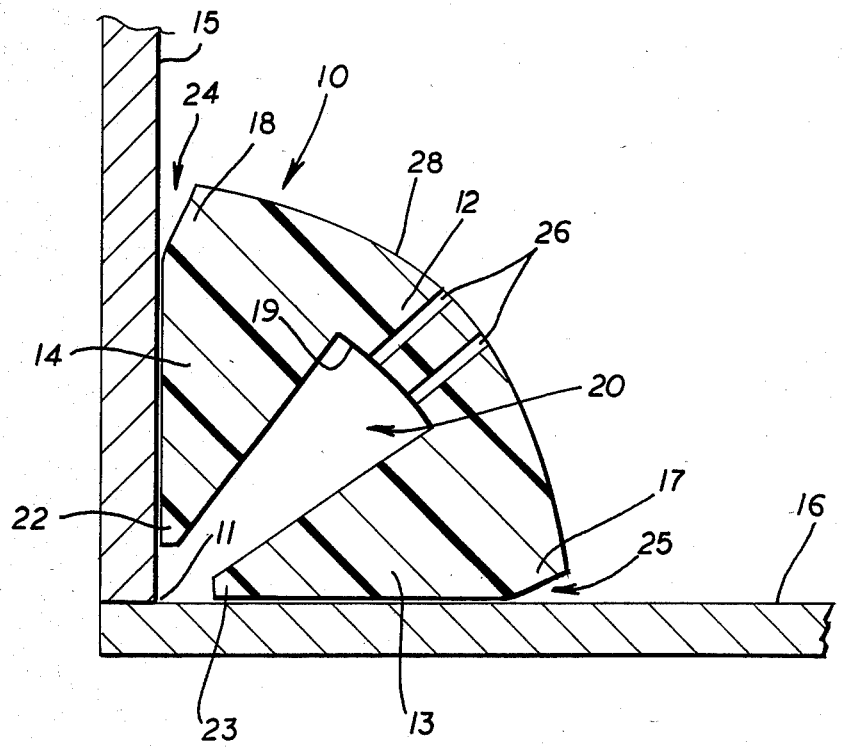
FIG. 2 is taken along lines 2—2 of FIG. 1 and shows the disclosed embodiment of the present invention.

In FIG. 2 is shown a cross-sectional view of the molding embodying the present invention. The molding comprises two elongate strips 13 and 14 whose cross-sections join and subtend the cross-section of an intermediate strip 12. The elongate strips 13, 14 comprise first and second sides of the molding 10 which are disposed towards the wall 15 and surface 16. The intermediate strip 12 joins the top edges 17 and 18 of the elongate strips 13 and 14, respectively, which are disposed away from the intersection 11 of wall 15 and surface 16. The two elongate strips 13 and 14 are formed with bottom edges 23 and 22, respectively, which extend toward the intersection 11 of wall 15 and surface 16 but terminate short of the intersection 11, thereby defining a cavity 20 with elongate strips 13, 14 and the inner surface 19 of intermediate strip 12.

Perforations 26 of a decorative pattern extend from the outer surface 28 of intermediate strip 12 to the cavity 20 thereby connecting the inner surface 19 to the outer surface 28. The perforations are preferably formed by passing the molding through a perforating die after extrusion.

Preferably, the molding is extruded from a resilient, pliable, and water-resistent material such as vinyl or the like. More rigid materials such as poly-vinyl chloride may also be used. If a pliable, flexible material is used, consumers may easily cut the molding with a knife or scissors. Flexible moldings are thus easy to apply and obtain professional results without professional skill. Metal molding, splash molding, or rigid tile molding cannot be as easily cut and applied, yet use of these materials is within the scope of the present invention. Compact rolls of vinyl or other flexible molding are easier to ship, store, and display than metal or rigid molding, and may also be less costly to ship great distances.

Figure 5:
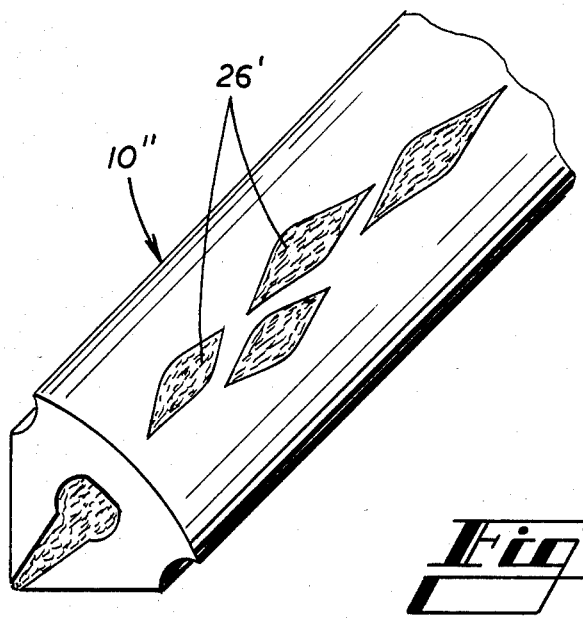

Advantageously, color combinations of caulking and molding may be chosen to enhance the aesthetic appeal of the molding. For example, a beige molding with green caulking for the leaf-and-stem pattern shown in FIG. 5 is a particularly pleasing pattern and color combination. Many other pattern styles, such as Grecian heads or Scandinavian designs, to name a few, may be used.

To apply the molding 10, a bead of caulking is laid down longitudinally along the intersection 11 of the horizontal surface 16 and the wall 15 in a quantity sufficient to completely seal the intersection 11 and provide an excess for filling cavity 20 and perforations 26. The molding 10 is then carefully placed over the bead of caulking with the outer surface 28 subtending the intersection 11, forcing the caulking up into the cavity 20 and through the perforations 26 in the intermediate strip 12.

Elongate strips 13, 14 include curved channels 24, 25 located opposite the intersection 11 at the point of the junction with intermediate strip 12. Channels 24, 25 allow application of an additional bead of caulking which forms an additional water tight seal. The excess caulking may be wiped off with a damp cloth to smooth appearance.

Figure 4:
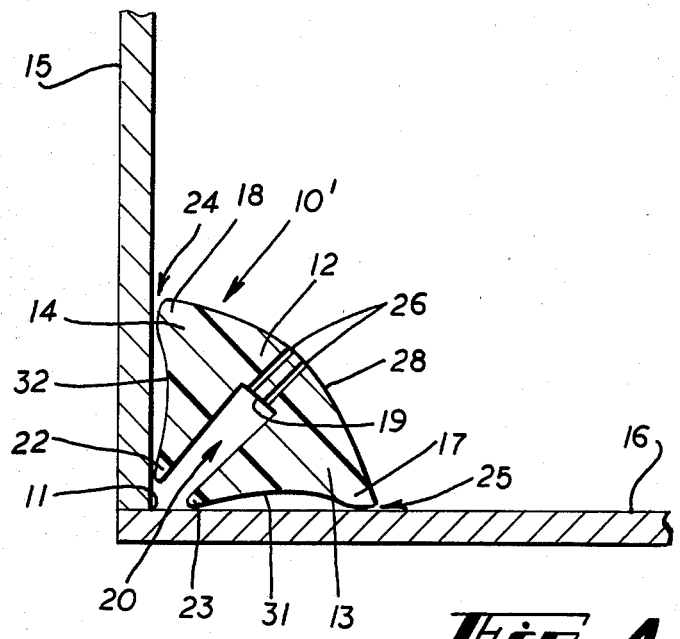
FIG. 4 is a cross-sectional view of a second embodiment of the present invention.

In a second embodiment 10' of the present invention shown in FIG. 4, elongate strips 13 and 14 are formed so as to include concave sides 31 and 32, respectively, to assist in the adhesion of the molding 10 to the surfaces 15 and 16. The molding is carefully placed over a bead of caulking with the perforated outer surface 28 facing away from the intersection 11. The molding is then pushed down toward the intersection 11 forcing the caulking into the cavity 20 and perforations 26. The caulking fills the cavity and is forced up through the perforations 26 in the intermediate strip 12. Caulking is also forced between the surfaces 15 and 16 and the concave sides 31, 32 of strips 13, 14. Since the preferred material for the molding is resilient, pushing down on the molding will force air out from under the concave sides 31, 32. When pressure is released, the resilient molding will tend to return to its natural shape, forming a suction against the surface and holding the molding in place. The excess caulking may then be wiped off with a damp cloth.

Figure 3:
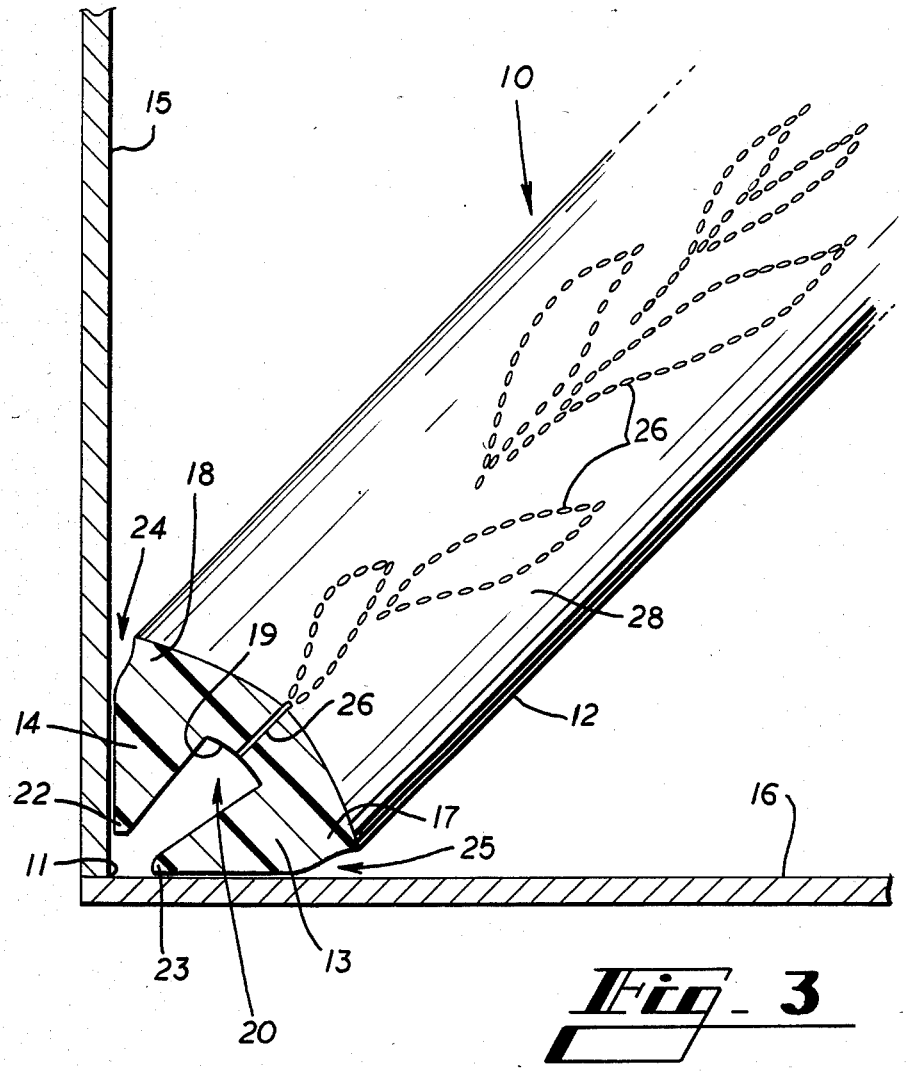
FIG. 3 is a partial perspective and cross-sectional view also taken along line 2—2 of FIG. 1 showing the disclosed embodiment of the present invention joining two surfaces.

FIG. 5 illustrates a third embodiment 10'' wherein the perforations 26' comprise portions of an entire filigree. It will be appreciated that the outline of the decorative pattern extends through the molding to the cavity 20, so that the caulking when it fills the perforations forms a full and continuous decorative pattern as opposed to the "dotted" pattern shown in FIG. 3. Instead of a small channel or plurality of dotted perforations forming the pattern, the pattern comprises the hollowed outline of a decoration which fills with caulking when the molding is applied. Moreover, additional caulking may be added from the outer surface 28 to fill the perforations after installation to insure that the perforated decorative pattern is completely filled. The caulking appearing or remaining at the surface 28 may be smoothed by wiping with a wet or solvent-dampened rag. Bold, full and brilliant patterns and color combinations are thereby made possible.

While the fundamental novel features of the invention have been shown and described, it should be understood that various substitutions, modifications and variations may be made by those skilled in the art without departing from the spirit or scope of the invention. Accordingly, all such modifications and variations are included in the scope of the invention as defined by the following claims.

What is claimed is:

1. A molding for protecting and sealing a joint formed by the angular intersection of two surfaces, comprising:

a first flexible, water-impervious elongate strip including a bottom edge and a top edge;

a second flexible water-impervious elongate strip including a bottom edge and a top edge;

a flexible, water-impervious intermediate elongate strip comprising an inner surface and a convex outer exposed surface, said intermediate strip joining said top edge of said first strip to said top edge of said second strip and forming an outer exposed surface of the molding;

said inner surface of said intermediate strip, said first strip and said second strip defining an elongate channel for receiving caulking; and, means defining a plurality of perforations in said intermediate strip extending between said outer exposed surface and said elongate channel for increasing the surface area of said channel for adhesion of caulking introduced into said channel, whereby caulking introduced into said channel for adhesion of said molding to said intersection appears at said outer exposed surface when said molding is affixed to said intersection.

2. The molding of claim 1, wherein each of said first and said second strips includes means defining concave side walls between said top and said bottom edges for assisting in the adhesion of said molding to said intersection.

3. The molding of claim 1, wherein each of said first and said second strips includes means defining curved channels located at the point of intersection of said first and said second strips adjacent said outer exposed surface of said intermediate strip, for receiving additional caulking.

4. A molding for protecting and sealing a joint formed by the angular intersection of two surfaces, said molding comprising:

an elongate flexible, water impervious member having a first side for placement adjacent one of said surfaces, a second side extending angularly with respect to said first side for placement adjacent the other one of said surfaces, and an outer side extending between and connecting said first and second sides;

means within said member between said first side and said second side defining an interior elongate cavity for receiving caulking; and means defining a plurality of perforations extending between said cavity and said outer side for increasing the surface area of said cavity for adhesion of caulking introduced into said cavity to allow caulking to flow from the cavity to the outer side of said elongate member.

* * * * *